United States Patent [19]

Hessler

[11] 4,087,354

[45] May 2, 1978

[54] INTEGRATED HEAT EXCHANGE ON CRUDE OIL AND VACUUM COLUMNS

[75] Inventor: Norman F. Hessler, Wheeling, Ill.

[73] Assignee: UOP Inc., Des Plaines, Ill.

[21] Appl. No.: 743,027

[22] Filed: Nov. 18, 1976

[51] Int. Cl.[2] ..... C10G 7/00

[52] U.S. Cl. ..... 208/251 R; 208/353; 208/354; 208/358

[58] Field of Search ..... 208/251 R, 352, 353, 208/354, 358, 365, 361

[56] References Cited

U.S. PATENT DOCUMENTS

| | | | |
|---|---|---|---|
| 1,997,675 | 4/1935 | Bahlke et al. | 208/365 |
| 2,338,595 | 1/1944 | Packie | 208/353 |
| 2,426,110 | 8/1947 | McCorquodale et al. | 208/353 |
| 3,886,062 | 5/1975 | Peiser et al. | 208/354 |
| 3,888,760 | 6/1975 | Ebert | 208/48 R |

*Primary Examiner*—Herbert Levine

*Attorney, Agent, or Firm*—James R. Hoatson, Jr.; Robert W. Erickson; William H. Page, II

[57] ABSTRACT

The amount of heat input required for the sequential fractionation of a crude oil in a crude column and a vacuum column is reduced by an improved heat exchange method wherein the desalted crude oil is flashed and the flash zone liquid is split into two streams. One of the streams is first heat exchanged against an atmospheric gas oil stream from the crude column and then against a first asphalt stream from the vacuum column. The other stream is first heat exchanged against a heavy vacuum gas oil stream from the vacuum column and then against a second asphalt stream from the vacuum column. The two streams are then recombined, heated and passed into the crude column.

2 Claims, 1 Drawing Figure

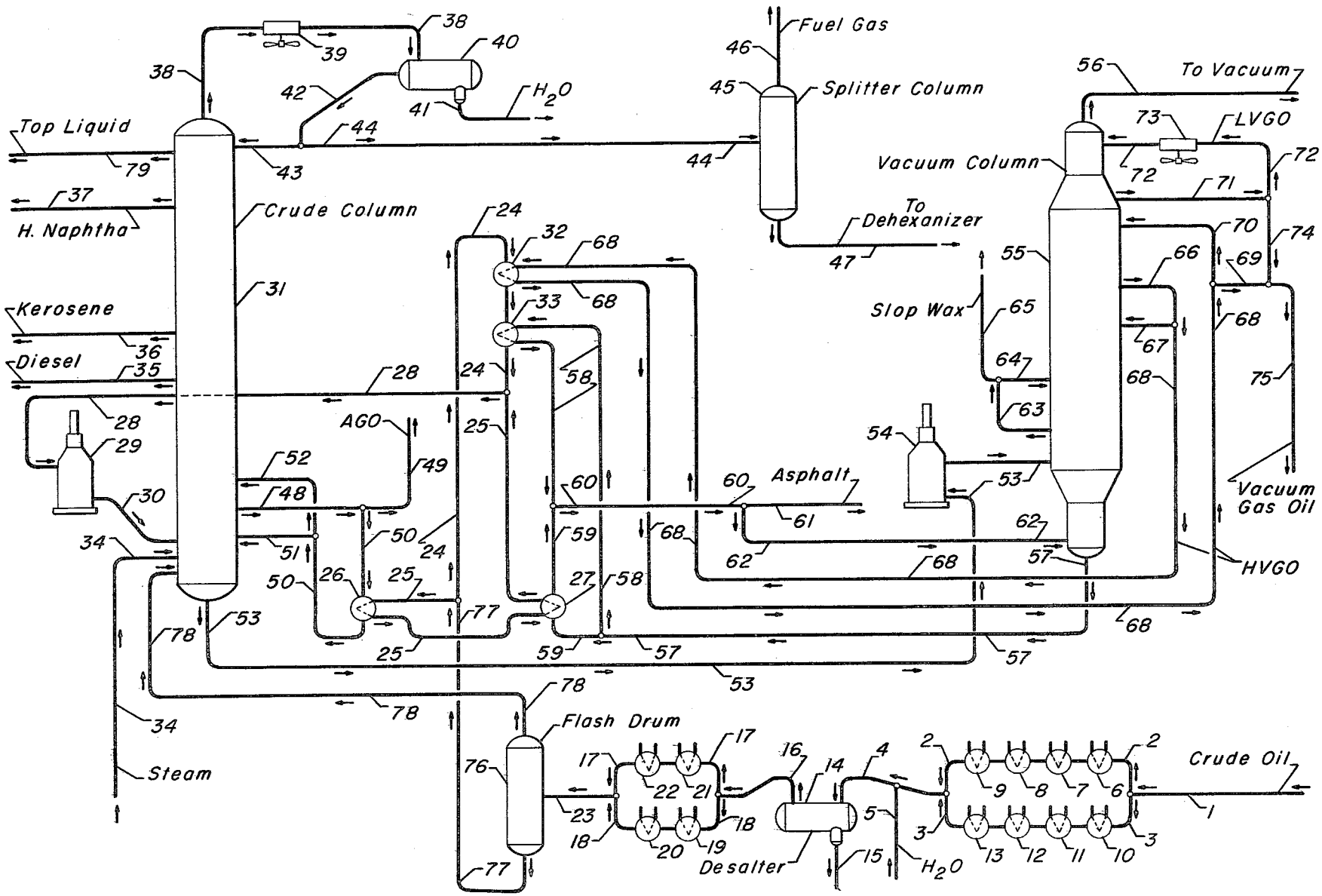
To Vacuum
LVGO
Vacuum Gas Oil
HVGO
Crude Oil
Vacuum Column
Slop Wax
To Dehexanizer
Splitter Column
Fuel Gas
Asphalt
Desalter
Flash Drum
$H_2O$
AGO
Crude Column
Steam
Top Liquid
H. Naphtha
Kerosene
Diesel

INTEGRATED HEAT EXCHANGE ON CRUDE OIL AND VACUUM COLUMNS

FIELD OF THE INVENTION

The invention relates to a process for the separation of mineral oils by fractional distillation. It also relates to the methods of heat exchange used to heat a crude oil before it is inserted into a crude oil fractionation column. It more specifically relates to an integrated heat exchange system wherein the desalted crude oil to be charged to a crude column is heated in part by heat exchange against liquid streams removed from a vacuum column. Processes concerned with similar areas of the art are found in Classes 208-353 and 208-354.

PRIOR ART

The fractionation of crude oil is probably the single most basic process used in the petroleum industry. Those skilled in the art are therefore well informed as to various apparatus designs and methods of operation for crude oil distillation. The crude oil is customarily charged into a crude oil column operated at a slight positive pressure to perform an initial separation. Due to various limits set on the operation of this column, such as operation below the temperature at which significant thermocracking begins to occur, the bottoms stream removed from such an "atmospheric" crude column contains a significant amount of valuable gas oils. This bottoms stream is therefore often subjected to further fractionation at a lower pressure and higher temperature in a column referred to as the vacuum column.

The basic principles of atmospheric and vacuum distillation of crude oils may be reviewed by such standard references as *Petroleum Refinery Engineering,* Nelson, 4th Ed., McGraw-Hill Book Co., New York, 1958. A more specific example of integrated crude and vacuum columns appears in U.S. Pat. No. 3,301,778 (Cl. 208-355) issued to J. T. Cabbage. This reference illustrates several features which are employed in the subject process and in most crude oil fractionation operations. These features include the removal of liquid sidecuts including kerosene and diesel oil from the crude column. These sidecuts are passed into individual sidecut strippers in which light ends are removed from the sidecut liquid for return to the crude column. A second common feature shown in this reference is the use of a pump-around loop to provide intercooling for the crude column. In this system a stream of hot liquid is removed from a tray within the column and cooled by passage through an indirect heat exchange means. Typically this heat is transferred into another liquid stream which it is desired to heat, such as a portion of the crude oil. The cooled liquid is then returned to the column at some point which is in relatively close vertical proximity to the point at which it is removed. It is normally returned about three or four trays above or below the draw-off point. In one mode of operation the hot liquid sidecut stream is divided into two portions, one of which is passed into a sidecut stripper, while the other one is passed into an intercooler heat exchanger and returned to the column. Pump-around loops are also normally employed on the vacuum column. The liquid sidecuts from the vacuum column may also be passed into sidecut strippers, but this is a less common situation.

The energy input required to vaporize the liquids entering the crude and the vacuum columns has resulted in a continuing effort to maximize the recovery of useful heat from various streams in these two columns. U.S. Pat. No. 3,819,511 (Cl. 208-353) issued to A. M. Peiser and M. J. DePasquale illustrates one method to reduce the utilities cost of operating a crude column. According to this method the raw crude is split into two parallel streams which are each heated by exchange against several streams, desalted and then further heated by exchange before being combined and passed into the crude column. This illustrates that the prior art has recognized the principle of sequentially exchanging against successively hotter streams and that it may be advantageous to split the crude oil into two parallel streams to provide a more effective or efficient heat exchange system. The reference is, however, limited to atmospheric crude columns and does not indicate how the operation of the crude column may be beneficially integrated with a vacuum column.

U.S. Pat. No. 3,886,062 (Cl. 208-354) also issued to A. M. Peiser and M. J. DePasquale presents a three tower pressure-to-vacuum distillation system featuring an integrated heat recovery system. In this rather complicated system the raw crude oil stream is first heat exchanged as an entity against three product streams and is then divided into two portions, one of which is exchanged in a pump-around loop while the other is exchanged against another product stream. The two portions are then reunited and exchanged against two pump-around loops and a fourth product stream before being passed into a desalter. The resultant desalted crude is heat exchanged against a product stream and split into two portions. One portion is heat exchanged against a pump-around loop on the pressurized crude column, and then against the net residual bottoms product stream of the vacuum column, another pump-around loop, one of the product streams and finally against the total bottoms stream removed from the vacuum column. The other portion of heated desalted crude is heat exchanged against four different pump-around loops and then remixed with the first portion. This combined stream is then exchanged against the slop from the vacuum column and passed into the pressurized crude column. This reference differs in the use of three columns and in the method of heat exchange used. One example of this difference is the failure of the reference to teach the division of the vacuum column bottoms (asphalt) stream into two portions, each of which is heat exchanged against a separate portion of the desalted crude.

Other references describing various facets of crude oil fractionation are U.S. Pat. Nos. 3,798,153 (Cl. 208-48AA); 3,296,121 (Cl. 208-350); 3,338,825 (Cl. 208-350) and 3,320,159 (Cl. 208-363).

BRIEF SUMMARY OF THE INVENTION

The invention provides a process for fractionating crude oil utilizing both an atmospheric crude column and a vacuum crude column in which the net heat input to perform the fractionation is reduced. This process comprises dividing a warm flash zone liquid stream into two portions, one of which is further heated by heat exchange against a pump-around stream of atmospheric gas oil and then against a portion of the total asphalt stream removed from the bottom of the vacuum column. The other portion of flash zone liquid is heated by indirect exchange against a stream of heavy vacuum gas oil and then against the remaining portion of the total asphalt stream.

DETAILED DESCRIPTION

In the fractionation of crude oils using both a crude column and a vacuum column it is necessary to vaporize a very high percentage of the crude oil stream and a sizable percentage of the crude column bottoms stream. This requires the expenditure of a large amount of energy. The cost of operating these columns and of obtaining the resultant petroleum derived products may therefore be lowered by performing the fractionation in a more energy efficient manner. One of the basic ways of recovering energy and improving the energy efficiency of a refining process is through expeditious heat exchange. It is the objective of this invention to provide a heat exchange method and a crude oil fractionation process which are highly energy efficient.

As used herein the terms crude column, crude oil column or crude oil fractionation column are intended to refer to a trayed fractional distillation column having means for the generation of reflux and for the vaporization of liquid removed from the bottom of the column for use within the column, which is operated at a superatmospheric pressure below about 40 psig. and to which a crude oil stream is charged. The terms vacuum column or crude oil vacuum column are intended to indicate a trayed fractionation column to which the net bottoms of a crude oil column is charged and which is operated at a subatmospheric pressure. Unless otherwise specified, all pressure indications refer to conditions at the top of the respective columns.

In describing the subject process it is necessary to refer to several multicomponent streams of hydrocarbonaceous liquids taken as sidecuts or bottoms streams from the columns. It is intended to adopt the customary definitions of those skilled in the art and classify these streams according to the location at which they are withdrawn from the respective fractionation column. The basic reason for this is that the boiling point ranges, as determined by the appropriate ASTM method, will vary depending on such factors as the crude oil composition, the capability of the column, the nature of the downstream processing units and the raw materials which it is desired to send to these units. In addition, the boiling point ranges of each stream may be affected by changes in operating conditions such as reflux ratio, pressure or temperature. The intended product slate and product specifications will also influence the boiling point ranges. Another possibility is that the columns may be provided with an alternative draw-off point to allow more flexibility in operation. It also is possible to adjust the initial boiling point (IBP) and end boiling point (EBP), etc. of many of the streams by the adjustment of the amount of intercooling performed at various points. For instance, the end point of the naphtha may be lowered. This has the effect of lowering the IBP of the kerosene sidecut stream and increasing its flow rate. Likewise any change in the EBP of the kerosene results in a corresponding change in the diesel fuel make.

As used herein the term atmospheric gas oil (AGO) refers to a stream removed near the bottom of the crude oil column and which has the highest EBP of any stream removed from this column with the sole exception of the bottoms stream. A typical atmospheric gas oil has a boiling point range of from about 400° to about 650° F. The bottoms stream of the crude column is also referred to as a reduced crude or topped crude. It may have an IBP of about 640° to 700° F. and will contain over 1 wt.% of asphaltenes.

The term vacuum gas oil is intended to refer to the various sidecut streams which may be removed from a vacuum column. Normally, two vacuum gas oil streams are removed from the vacuum column. The stream having a higher boiling point range and removed at a lower point in the column is referred to in the art as a heavy vacuum gas oil (HVGO). The stream removed above the HVGO drawoff is referred to as a light vacuum gas oil (LVGO). These two streams may be removed from the process as separate product streams or may be blended into a single product stream. A typical HVGO will have a boiling point range of from about 650° to about 1050° F. and may be further characterized in that it contains less than about 0.3 wt.% asphaltenes. The vacuum gas oil streams are to be distinguished from a stream of heavy material which is removed near the bottom of the vacuum column and referred to as slop or slop wax. This stream is too viscous for use as fuel oil without being blended with a cut oil. However, it normally has a relatively low asphaltene content and is a suitable lube oil base stock after propane deasphalting. A typical slop wax has a gravity of about 11.0° to 16.5° API and an average molecular weight of about 580 to 620 or higher.

The bottoms stream of a vacuum column is referred to herein as an asphalt stream. This is because of the high asphaltene content of this material, which ranges from about 2 to 20 wt.%, and its essentially nondistillable character. These characteristics often relegates it to use as a bonding agent for aggregates to form paving material or for roof sealing. It may, however, be subjected to subsequent processing such as air blowing, propane deasphalting or coking, etc. A vacuum column bottoms stream may be characterized as having an IBP above 1000° F., containing less than 50 vol.% distillable hydrocarbons and having a gravity of from about 1.0 to 8.5° API. The average molecular weight of the asphalt may be from about 700 to 900 or higher. Asphalt is sometimes referred to as pitch.

According to the preferred embodiment, the warm desalted crude oil is passed into a flash zone which separates it into a vapor stream and a liquid stream. This is a customary step in crude oil fractionation. Effective flashing conditions include a positive pressure less than that used in the previous heat exchange and preferably from about 10 to 30 psig. and a temperature of from about 280° to 500° F. or higher. Further details of the operations of desalting and flashing may be obtained by reference to U.S. Pat. No. 3,798,153 (Cl. 208-48AA).

The Drawing illustrates the preferred embodiment of the invention. The crude and vacuum units have a large number of lines carrying the various sidecuts and pumparound loops which have not been shown in order to more clearly present the inventive concept. Likewise, a large number of subsystems including controllers, valves, steam generators, fractionation trays, etc., have not been shown. These accouterments do not form part of the inventive concept, and they may be any of the various types which are customarily used. This description of the drawing and the example given below are not intended to preclude the reasonable variation and modification of the disclosed invention as can be made by one skilled in the art.

Referring now to the Drawing, a stream of raw crude oil enters the process through line 1. This stream contains water removed from the desalter 14. It is split into two portions, with the first portion traveling through line 2. The temperature of this first portion is increased by indirect heat exchange against a stream of crude column top pump-around liquid in heat exchanger 6, against a bottom stream from a kerosene sidecut stripper in exchanger 7, against the bottoms of a diesel oil sidecut stripper in exchanger 8 and finally against a kerosene sidecut stream which has previously been used to heat a stream of desalted crude oil. The second portion of the raw crude oil is passed through line 3. Its temperature is increased by heat exchange against the crude column top pump-around liquid in exchanger 10 and against the product draw (bottoms stream) removed from the heavy naphtha stripper in heat exchanger 11. It is then exchanged against a portion of the AGO product stream removed from the crude column in exchanger 12. Finally it is heated in exchanger 13 by a second portion of the same kerosene sidecut which is used in heat exchanger 9. The two portions of now-heated crude oil are combined and passed into a first desalter which is not shown through line 4. A brine stream is rejected from the first desalter. A stream of water from line 5 is admixed with the crude oil removed from the first desalter and is passed into a second desalter 14. A water stream is removed in line 15 for admixture with the raw crude oil.

The desalted crude oil is removed from the second desalter in line 16 and divided into two portions. The portion of the desalted crude which passes through line 17 is heated by heat exchange against a first portion of a kerosene sidecut stream in heat exchanger 21 and then by a first portion of a diesel oil sidecut in heat exchanger 22. The portion of the desalted crude flows through line 18 is heated by a second portion of the kerosene sidecut in heat exchanger 19 and against a second portion of the diesel oil sidecut in heat exchanger 20. The two portions of desalted crude oil are then combined and passed through line 23 into a flash drum 76. Vapors from this flash drum are passed into the crude column via line 78.

The liquids remaining after the flashing operation are withdrawn in line 77 and divided into two portions, with one portion passing through line 25 and a second portion passing through line 24. The flash drum liquid passing through line 25 is heat exchanged against a stream of AGO passing through line 50 in heat exchange means 26. It is then further increased in temperature by heat exchange against an asphalt stream passing through line 59 and heat exchange means 27. The other portion of flash drum liquid, which is passing through line 24, is increased in temperature by heat exchange in exchanger 32 against a stream of HVGO passing through line 68 and then in heat exchange means 33 by indirect heat exchange against a stream of asphalt passing through line 58. The two portions of flash drum liquid in lines 24 and 25 are then admixed and passed through line 28 to a fired heater 29. The effluent of the heater is passed into the crude column 31 through line 30.

The crude column is operated under conditions effective to cause the separation of the crude oil into a bottoms stream removed in line 53, a stream of AGO removed in line 48, a diesel oil sidecut stream removed in line 35, kerosene removed in line 36, heavy naphtha removed in line 37, and overhead vapors removed in line 38. A top liquid stream is removed in line 79. This is a pump-around stream used to remove heat from the column, and no part of the top liquid is withdrawn as a product. The sidecuts removed in lines 35, 36 and 37 are passed to sidecut strippers which are not shown. The return lines carrying the overhead vapors of the sidecut strippers back to the crude column are also not shown as these are customary and well known in the art. Heat is recovered from these sidecut streams by heat exchange against the incoming crude oil in the manner previously described. Steam is added to the bottom of the crude column through line 34 to aid in the fractionation.

The overhead vapors of the crude column are passed through an overhead condenser 39. The resulting condensate stream is passed into overhead receiver 40 and separated into a hydrocarbon liquid phase and an aqueous phase. A water stream is removed from the overhead receiver in line 41. This is the water which is contained in the sidecut stripper overhead vapor streams and the steam added through line 34. A stream of light liquid hydrocarbons is removed from the receiver in line 42. A first portion of this stream is returned to the top of the crude column as reflux in line 43. This portion is admixed with top pump-around liquid which is used for heating the crude oil in heat exchangers 6 and 10 before entering the column. A second portion of the overhead liquid is passed through line 44 into a splitter column 45. The splitter column removes the $C_5$- hydrocarbons in line 46 for use as fuel gas or for passage to a gas concentration unit. The $C_6$+ portion of the overhead liquid is removed in line 47 and passed into a dehexanizer.

The AGO stream which is removed from the crude column in line 48 is divided into a product stream removed in line 49 and a pump-around stream which is passed through line 50. The hot AGO passing through line 50 is passed through the heat exchanger 26 to heat one of the two portions of flash drum liquid. It is then itself split into two portions and returned to the crude column at two separate vertical points through lines 51 and 52. The bottoms stream of the crude column is removed in line 53 and passed through a fired heater 54 before being inserted into the vacuum column 55.

The vacuum column is operated under conditions which are effective to separate the entering crude column bottoms stream into an overhead vapor stream removed in line 56, a stream of LVGO removed in line 71, a stream of HVGO removed in line 66, a stream of slop wax removed in line 63 and an asphalt bottoms stream removed in line 57. The asphalt bottoms stream is divided into a first portion passing through line 59 and a second portion passing through line 58. The asphalt stream passing through line 59 is used to heat the flash drum liquid in heat exchange means 27. The second asphalt stream passing through line 58 is used to heat a portion of the flash drum liquid in heat exchange means 33. The two asphalt streams are then combined and directed into line 60. A net asphalt stream is removed from the process in line 61 as a product stream, while the remaining portion of asphalt is returned to the bottom of the vacuum column through line 62. The slop wax stream removed in line 63 is also divided into two portions. A first portion is not heat exchanged and is returned to the vacuum column in line 64. A second portion of the slop wax may be rejected through line 65 as a net product stream or may be admixed with the crude column bottoms stream carried by line 53. If removed as a product stream, it may be blended with the asphalt stream removed from the process in line 61.

A portion of the HVGO which is removed from the vacuum column in line 66 is returned to the vacuum column in line 67 without passing through a heat exchanger. The remaining portion of the HVGO passes through line 68 to heat exchange means 32 wherein it is used to heat a portion of the flash drum liquid stream. It then flows through line 68 to the point at which it is bifurcated into a stream of HVGO returned to the vacuum column in line 70 and a stream of HVGO which is removed as a product stream in line 69. The stream of LVGO which is removed in line 71 is divided into a product stream removed in line 74 and a recycle stream passed through line 72. The LVGO recycle stream is cooled in an air cooler 73 and returned near the top of the vacuum column. The LVGO product stream in line 74 is blended with the HVGO product stream from line 69 to form a combined vacuum gas oil product stream removed from the process in line 75.

The preferred embodiment of the invention may be characterized as a process for fractionating a crude oil which comprises the steps of desalting a crude oil feed stream to form a desalted crude oil stream, heating the desalted crude oil stream by indirect heat exchange against a liquid stream removed as a side cut from a crude oil fractionation column, dividing the desalted crude oil stream into a flash drum vapor stream and a flash zone liquid stream by passing the desalted crude oil stream into a flash zone operated at effective flashing conditions, passing the flash zone vapor stream into the crude oil fractionation column, dividing the flash zone liquid stream into a first and a second aliquot portion having the same composition, heating the first aliquot portion of the flash zone liquid stream by indirect heat exchange against a heavy vacuum gas oil stream and then by indirect heat exchange against a first asphalt stream, heating the second aliquot portion of the flash zone a liquid stream by indirect heat exchange against an atmospheric gas oil stream comprising hydrocarbonaceous liquid removed from the bottom one-half of the crude oil fractionation column and then by indirect heat exchange against a second asphalt stream, recombining the first and second aliquot portions of the flash zone liquid stream and passing the flash zone liquid stream into the crude oil fractionation column after further heating, the crude oil fractionation column being operated at conditions effective to separate the desalted crude oil stream into a crude column bottoms stream, the atmospheric gas oil stream and at least two other liquid sidecut streams having lower end boiling points than the atmospheric gas oil stream, including a pressure above about 5 psig. and a bottoms liquid temperature of from 500° to about 720° F., heating the crude column bottoms streams and passing the crude column bottoms stream into a crude oil vacuum column operated under conditions effective to separate the crude column bottoms stream into an asphalt bottoms stream, a heavy vacuum gas oil sidecut stream and a light vacuum gas oil sidecut stream, including a bottoms temperature of from about 650° to about 770° F. and a pressure of less than one atmosphere absolute, dividing the heavy vacuum gas oil sidecut stream into a first aliquot portion which is returned to the crude oil vacuum column and a second aliquot portion which is utilized as the heavy vacuum gas oil stream, and then dividing the heavy vacuum gas oil stream into a first and a second aliquot portion after heat exchange against the first portion of the flash zone liquid stream, with the first portion of the heavy vacuum gas oil stream also being returned to the crude oil vacuum column and the second portion being removed as a product, and dividing the asphalt bottoms stream into a first and a second aliquot portions and thereby forming the first and the second asphalt streams, recombining the first and second asphalt streams after their respective heat exchange operations to form a cooled asphalt stream, passing a first portion of the cooled asphalt stream into the crude oil vacuum column and removing a second portion of the cooled asphalt stream as a product.

The invention is further illustrated by this example of the preferred embodiment. The charge stream to the crude column is a 100,000 barrel per day (BPD) stream of a 34.5° API light Arabian crude oil. This stream is divided into two approximately equal portions. The first portion is admixed with about 4000 BPD of water from the second desalting stage and passed into heat exchanger 6 at about 95° F. It is heated to approximately 160° F. by exchange against one part of the crude column top pump-around stream. This material is removed from a trap-out tray located between the third and fourth fractionation tray from the top of the column. Part of this material is returned to the crude column at the fourth tray and the remainder is admixed with the overhead liquid returned to the crude column as reflux. The crude oil is then heated to about 200° F. by indirect heat exchange against the bottoms streams of the kerosene sidecut stripper in heat exchanger 7. In heat exchanger 8 the first portion of crude oil is further heated to 246° F. by exchange against the bottom of the diesel oil sidecut stripper. It is then heated to 262° F. in exchange 9 by exchange against one portion of the kerosene sidecut which has previously been exchanged against a desalted crude stream in exchanger 19.

The second portion of raw crude is warmed from 95° to about 160° F. in exchanger 10 against the remaining part of the previously described crude column top pump-around stream. It is then heated to close to 190° F. by the bottoms stream of the naphtha sidecut stream. Exchange against the AGO product stream in heat exchanger 12 raises the temperature of this stream of raw crude to about 255° F. The temperature is finally raised to close to 269° F. in exchanger 13 by exchange against the portion of the kerosene sidecut stream used for heating the desalted crude in exchanger 21. The two raw crude streams are mixed and passed into a first desalter from which undissolved water is decanted. A second stream of water is added to the crude before it is passed through a second desalter 14.

The now desalted crude is again split into two approximately equal parallel streams. Each stream is heated to about 317° and then to about 380° F. by indirect contact with one part of the kerosene sidecut stream and then with one part of the diesel oil sidecut stream. The two streams of desalted crude are admixed and passed into a flash drum maintained at a pressure of about 15 psig. About 48,400 lbs./hr. of water vapor and gaseous hydrocarbons are removed from the flash drum and passed into the bottom of the crude column. This produces a 95,685 BPD stream of liquid hydrocarbons.

According to the inventive concept this liquid stream is split into two approximately equal portions. The first portion is heat exchanged against an HVGO stream in exchanger 32 to increase its temperature to about 495° F. and against an asphalt stream in exchanger 33 to raise its temperature to about 515° F. The second portion of flash drum liquid is first heated to 505° F. in heat exchanger 26 by the AGO pump-around stream and then to about 525° F. by heat exchange against the other asphalt stream in exchanger 27. Admixture of the two liquid streams produces a 520° F. crude column feed stream which is charged into a fired heater. The mixed-phase effluent of this heater has a temperature of about 712° F. and a pressure of approximately 17 psig. It is charged directly into the crude column. About 15,900 lbs./hr. of 50 psig. steam is also charged to the bottom of the crude column.

The streams removed from the crude column include a 38,100 BPD bottoms stream having a gravity of 15.9° API and a temperature of approximately 680° F. The total AGO sidecut stream has a temperature of about 575° F. and a gravity of 30° API. The portion which is removed as a product stream in line 49 has a flow rate of 10,300 BPD and is heat exchanged against one of the streams of undesalted crude oil in exchanger 12. The remaining portion of the total AGO sidecut is exchanged against one of the streams of flash drum liquid and is thereby cooled to about 440° F. This portion is then split into two smaller streams and returned to the column in the manner illustrated.

The next lightest sidecut stream removed from the crude column is a 37.3° API diesel oil stream having a temperature of about 505° F. One portion of this sidecut is stripped with 50 psig. steam, with the resultant overhead vapors being returned to the crude column in the customary manner at a pressure of 13 psig. The bottoms stream of the stripper is exchanged against undesalted crude in exchanger 8 and removed at the rate of about 10,400 BPD. A second portion of the diesel oil sidecut is divided into three smaller streams. Two of these are used to heat the two streams of desalted crude in exchangers 20 and 22, and a smaller stream is used to reboil the naphtha stripper. The material forming these three streams is then returned to the crude column as the cooled part of the pump-around stream. In a similar manner a 410° F. stream of kerosene is removed from the column and split into two portions. One portion is stripped with 50 psig. steam to form a 12,000 BPD product stream having a gravity of 44° API. This stream is cooled from 390° to 210° F. by raw crude oil in heat exchanger 7. Stripper overhead vapors are again returned to the column. A larger portion of the kerosene sidecut stream is divided into two streams which are passed in parallel through heat exchangers 19 and 21 and then through exchangers 9 and 13. These streams are then returned to the crude column at a lower temperature of about 300° F.

A heavy naphtha sidecut having a gravity of about 52.6° API is removed from the crude column at a temperature of 300° F. A first portion of this sidecut is passed into a reboiled stripper to produce a 12,000 BPD product stream having a temperature of 350° F. The naphtha product stream is then cooled to 210° F. in heat exchanger 11. The remaining portion of the heavy naphtha sidecut is returned to the crude column at a point below the draw-off tray at a temperature of 300° F. The top pump-around stream has a gravity of about 67.0° API and is removed at a temperature of 210° F. This stream is also split into two parallel streams which are cooled in heat exchangers 6 and 10 respectively. This top pump-around material has a temperature of about 145° F. after the crude oil heat exchange and is returned to the column.

An overhead vapor stream is removed from the crude column at the rate of about 4,125 moles/hr. It has a temperature of 197° F. and a pressure of 10 psig. This stream is cooled to about 100° F. and passed into an overhead receiver. The hydrocarbon liquid phase collected in the receiver has a gravity of about 76.3° API. A net overhead liquid is removed as a product stream passed into a dehexanizer at the rate of about 17,545 BPD. About 630 moles/hr. of overhead receiver liquid is returned to the column in admixture with a portion of the top pump-around stream as reflux. Water is decanted from the overhead receiver at the rate of approximately 1,540 moles/hr.

The bottoms stream of the crude column is heated to about 770° F. and then flashed into the vacuum column at a pressure of 15 mm. of Hg absolute. An asphaltic bottoms stream having a gravity of 2° API is removed at a temperature of about 685° F. This total asphalt stream has a flow rate of approximately 205,500 lbs./hr. It is divided into two approximately equal smaller asphalt streams. The first asphalt stream is heat exchanged against flash drum liquid in heat exchanger 33 and the second asphalt stream is used to heat flash drum liquid in exchanger 27. The two streams are then recombined. A net asphalt product stream having a flow rate of about 162,500 lbs./hr. is withdrawn in line 61. The remaining portion of the asphalt stream is returned to the bottom of the vacuum column at a temperature of approximately 560° F.

An HVGO stream is removed from the crude column at 540° F. A first portion of this 11.9° API stream is returned to the vacuum column as shown. The remaining portion of the HVGO has a flow rate of approximately 736,500 lbs./hr. This HVGO stream is used to heat flash drum liquid in heat exchanger 32 and to generate steam. It is then divided into a net HVGO product stream of about 288,000 lbs./hr. and a recycle HVGO stream which is cooled to about 175° F. and passed into the vacuum column. A 650° F. stream of 15° API slop wax stream is withdrawn from the column and also split into two streams. The smaller of these streams is passed into the vacuum column heater, and the larger stream is returned directly to the vacuum column. The LVGO is removed at the rate of about 411,000 lbs./hr. This material has a temperature of 200° F. and a gravity of 28.7° API. A net LVGO product stream having a flow rate of about 81,800 lbs./hr. (6,350 BPD) is admixed with the net HVGO product stream. The remaining portion of the LVGO is cooled to about 100° F. and passed into the top of the vacuum column. About 1,500 lbs./hr. gases having an average molecular weight of 36 is removed at the top of the column through use of jet ejectors developing a vacuum of about 5 mm. Hg absolute.

I claim as my invention:

1. A process for fractionating a crude oil which comprises the steps of:

(a) desalting a crude oil feed stream to form a desalted crude oil stream;

(b) heating the desalted crude oil stream by indirect heat exchange against a liquid stream removed as a sidecut from a crude oil fractionation column;

(c) dividing the desalted crude oil stream into a flash zone vapor stream and a flash zone liquid stream by passing the desalted crude oil stream into a flash zone operated at effective flashing conditions;

(d) passing the flash zone vapor stream into the crude oil fractionation column;

(e) dividing the flash zone liquid stream into a first and a second aliquot portion having the same composition;

(f) heating the first aliquot portion of the flash zone liquid stream by indirect heat exchange against a heavy vacuum gas oil stream and then by indirect heat exchange against a first asphalt stream;

(g) heating the second aliquot portion of the flash zone liquid stream by indirect heat exchange against an atmospheric gas oil stream comprising hydrocarbonaceous liquid removed from the bottom one-half of the crude oil fractionation column and then by indirect heat exchange against a second asphalt stream;

(h) recombining the first and second aliquot portions of the flash zone liquid stream and passing the flash zone liquid stream into the crude oil fractionation column after heating, the crude oil fractionation column being operated at conditions effective to separate the desalted crude oil stream into a crude column bottoms stream, the atmospheric gas oil stream and at least two other liquid sidecut streams having lower end boiling points than the atmospheric gas oil stream, including a pressure above about 5 psig. and a bottoms liquid temperature of from 500° to about 720° F.;

(i) heating the crude column bottoms streams and passing the crude column bottoms stream into a crude oil vacuum column operated under conditions effective to separate the crude column bottoms stream into an asphalt bottoms stream, a heavy vacuum gas oil sidecut stream and a light vacuum gas oil sidecut stream, including a bottoms temperature of from about 650° to about 770° F. and a pressure of less than one atmosphere absolute;

(j) dividing the heavy vacuum gas oil sidecut stream into a first aliquot portion which is returned uncooled to the crude oil vacuum column and a second aliquot portion which is utilized as the heavy vacuum gas oil stream of step (f), and then dividing the heavy vacuum gas oil stream into a first and a second aliquot portion after heat exchange against the first portion of the flash zone liquid stream, with the first portion of the heavy vacuum gas oil stream also being returned to the crude oil vacuum column and the second portion being removed as a product; and, (k) dividing the asphalt bottoms stream into a first and a second aliquot portion and thereby forming the first and the second asphalt streams, recombining the first and second asphalt streams after the respective heat exchange operations of steps (f) and (g) to form a cooled asphalt stream, passing a first portion of the cooled asphalt stream into the crude oil vacuum column and removing a second portion of the cooled asphalt stream as a product.

2. The process of claim 1 further limited in that the desalted crude oil stream is heated prior to passage into the flash zone by heat exchange against a diesel oil stream removed as a sidecut from the crude oil fractionation column.

* * * * *